United States Patent [19]

Kerr

[11] Patent Number: 4,644,558

[45] Date of Patent: Feb. 17, 1987

[54] ROOF ASSEMBLY FOR AN ELECTRIC ARC FURNACE

[75] Inventor: Robert L. Kerr, Poland, Ohio

[73] Assignee: Wean United, Inc., Pittsburgh, Pa.

[21] Appl. No.: 740,378

[22] Filed: Jun. 3, 1985

Related U.S. Application Data

[63] Continuation of Ser. No. 507,416, Jun. 24, 1983.

[51] Int. Cl.[4] ..... F27D 1/02; F27D 1/12

[52] U.S. Cl. ..... 373/74

[58] Field of Search ..... 373/74, 76; 266/280, 266/286; 432/248, 250; 110/331, 335, 336

[56] References Cited

U.S. PATENT DOCUMENTS 4,021,603 5/1977 Nanjyo et al. ..... 373/74

4,216,348 8/1980 Greenberger ..... 373/74

*Primary Examiner*—Roy N. Envall, Jr.

*Attorney, Agent, or Firm*—Arnold B. Silverman; Suzanne Kikel

[57] ABSTRACT

A roof assembly for an electric arc furnace having a plurality of water cooled trapezoidal-shaped roof segments or panel units arranged in a circular manner and having arcuate surfaces which abut inner and outer fabricated welded support rings and having longitudinal surfaces which do not contact the adjacent panels when in an assembled form. The arcuate surface abutting the inner ring is slanted downwardly towards the outer ring from the top to the bottom surface of the panel, and that abutting the outer ring may have point contact creating a wedging effect for each panel between the support rings. The outer ring provides several spaced apart load bearing members defining openings which permit debris to slide off the assembled roof thereby limiting build-up on the roof, and a conduit of the support rings carries coolant to protect the weldment areas of the rings.

3 Claims, 8 Drawing Figures

ROOF ASSEMBLY FOR AN ELECTRIC ARC FURNACE

This is a continuation, of application Ser. No. 507,416 filed June 24, 1983.

BACKGROUND OF THE INVENTION

The present invention relates to a roof assembly for an electric arc furnace used for melting metals, and has particular application in a roof assembly of the type consisting of inner and outer support rings, a ring for containment of a refractory electrode-delta center, and a number of water-cooled roof segments or panel units circularly arranged to have their sides adjacent each other between the two support rings.

Past designs for a roof of an electric arc furnace having water-cooled segments or panel units included at least two types: an overhead support structure for suspending the panel units as taught in U.S. Pat. No. 4,216,348; or an arrangement where the panel units are designed to abut each other to be self-supporting as disclosed in U.S. Pat. No. 4,021,603.

There are several disadvantages associated with both types. In the first design, i.e. U.S. Pat. No. 4,216,348, radial support beams in the overhead support structure interfer with the easy insertion and removal of the roof panels since handling of the panels from above the roof assembly is desirable. Consequently, disassembling of one or more of the radial beams was necessary. In addition, and aside from the substantial added costs the overhead support structure adds a substantial amount of weight to the roof assembly, which, in the case of cast metal roof segments, this additional weight can be prohibitive.

The design in U.S. Pat. No. 4,021,603, for the most part, does not have the problems previously mentioned with regard to U.S. Pat. No. 4,216,348 patented overhead suspension design. However, this design also has serious disadvantages.

First, proper sizing and close tolerance of the segments and outer ring is mandatory. Since abutment of each roof segment relative to each adjacent one and their containment in the outer ring provide for the self-supporting feature of the roof assembly, the manufacturing of these segments require very close tolerances in order to achieve proper assemblage and support thereof. Oversizing or undersizing of any one or more of the segments or the outer ring may interfer with the object of the self-supporting aspect. Maintenance of this design presents other problems. To remove a single roof segment for repair or replacement, removal of the refractory electrode center is required since the assembled segments support the refractory center. In addition, the assembled remaining segments must be kept in their initial refractory supporting position. Otherwise, the entire roof assembly has to be removed from the furnace for the repositioning of the segments.

A third problem with regard to the U.S. Pat. No. 4,021,603 design still involves the abutting relationship of the assembled roof segments relative to each other. In high and ultrahigh power furnaces, this abutting relationship can be disrupted due to the substantial amount of expansion and contraction of the panels caused by the extreme thermal variations in the furnace. The results may invariably be distortion or failure of some or all the segments and perhaps a total collapse of the roof.

Inherent in each of the two above roof designs is the likelihood of the accumulation of debris on the top of the assembled roof.

The above disadvantages and limitations of the roof assembly designs are overcome by the features of the present invention.

SUMMARY OF THE INVENTION

It is, therefore, an object of the present invention to provide an arrangement of panel units such that each panel unit is individually supported so that the displacement or removal of one or more panels will not disturb the remaining assembled roof.

More particularly, it is an object of the present invention to provide a roof assembly wherein the panels are designed to compressively fit between the outer and inner support rings to become an integral support member of the total roof assembly, and still independent of the adjacent panels for any support.

A still further object of the present invention is to provide in a design for a roof assembly having inner and outer support rings, panel units constructed and arranged so that a non-contacting relationship along the longitudinal sides of the assembled panels is created.

And yet a still further object of the subject invention is to provide a fabricated welded design for inner and outer support rings which contain means for cooling and preserving the weldments thereof, and in the case of the outer ring, a series of openings through which accumulated debris can flow so as to be removed from the top of the roof assembly.

More particularly, an object of the present invention is to provide a roof assembly for an electric arc furnace having a centrally located electrode area, comprising: a first support ring means defining the outer periphery of said roof assembly; a second support ring means located concentrically and inwardly of and at a higher elevation than said first ring means and defining the outer periphery of said electrode area; and a plurality of trapezoidal-shaped panel units assembled between said first and said second ring means in a circular fashion which forms a frustonoconically cross-sectional shaped main roof section; each said panel unit has arcuate bases with one shorter than the other and longitudinal sides, and are arranged in a manner that along the length of said sides a non-contacting relationship exists relative to an immediate arranged adjacent panel unit, and said arcuate bases are constructed such that they contact and create a compressive fit between said first and said second ring means in a manner that each panel unit is supported only by said first and said second ring means and its weight is transferred down to said first ring means.

BRIEF DESCRIPTION OF THE DRAWINGS

These objects, as well as other novel features and advantages of the present invention, will become better appreciated and understood when the following description of the preferred embodiment is read along with the accompanying drawings of which.

DESCRIPTION OF THE PREFERRED EMBODIMENT

Figures 1, 6:
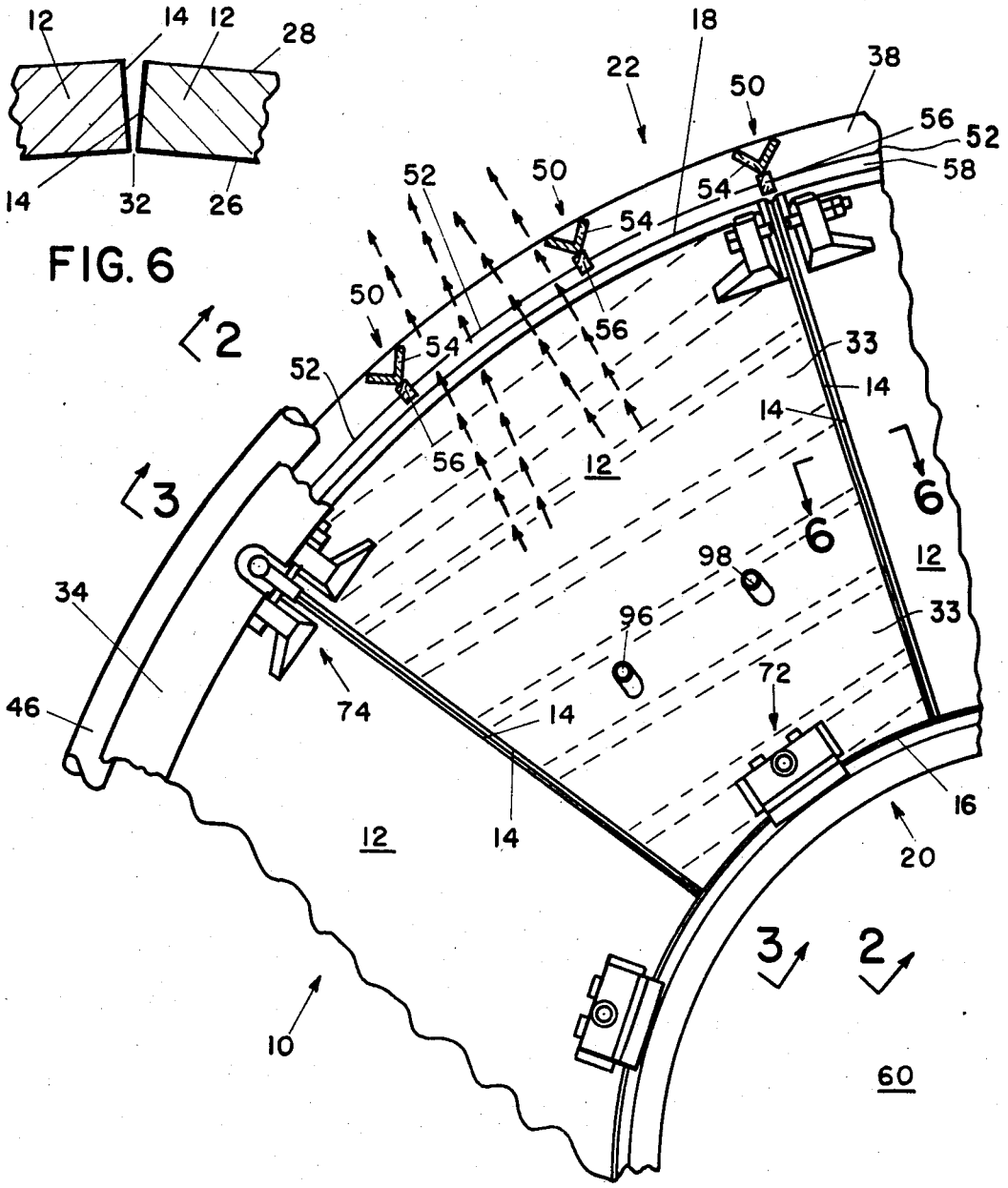
FIG. 1 is a broken-away partial plan view of the assembled panel units comprising part of a roof assembly.
FIG. 6 is an enlarged section taken along lines 6—6 of FIG. 1.

Referring first to FIG. 1, this FIG. 1 illustrates a roof assembly 10 for an electric arc furnace consisting of several circularly arranged trapezoidalshaped panel units 12. Each panel unit 12 has two longitudinal sides 14, and two arcuate bases 16 and 18, and are arranged such that their longitudinal sides 14 run parallel to that of an immediately neighboring panel unit to form a circular main roof section, which is generally frustoconical in the vertical cross section, similar generally to the roof assemblies disclosed in U.S. Pat. Nos. 4,021,603 and 4,216,348. These patents show other well-known components of the furnace; particularly of the roof, such as, outer and inner rings, and a center delta fractory electrode section, commonly referred to as a roof top or closure, and for this reason certain components will not be described in detail.

Figure 2:
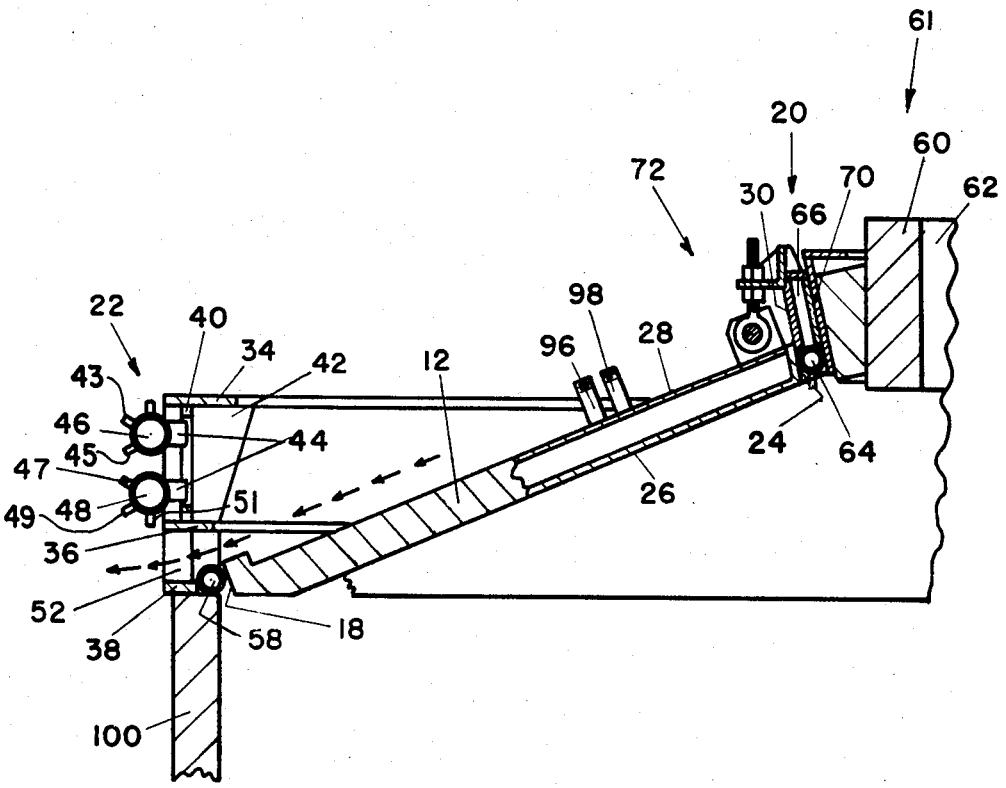
FIG. 2 is a sectional view taken along lines 2—2 of FIG. 1.
Figure 3:
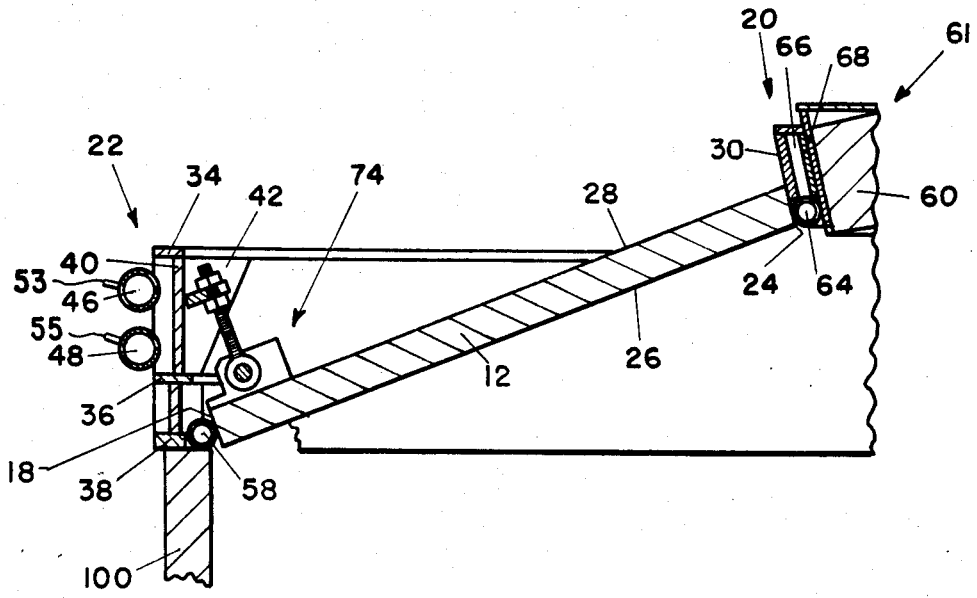
FIG. 3 is a sectional view taken along lines 3—3 of FIG. 1.
Figure 4A:
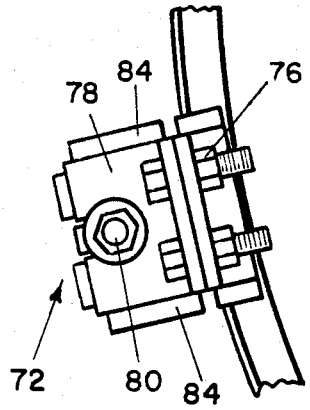
FIG. 4*a* is a plan view of FIG. 4.
Figure 4:
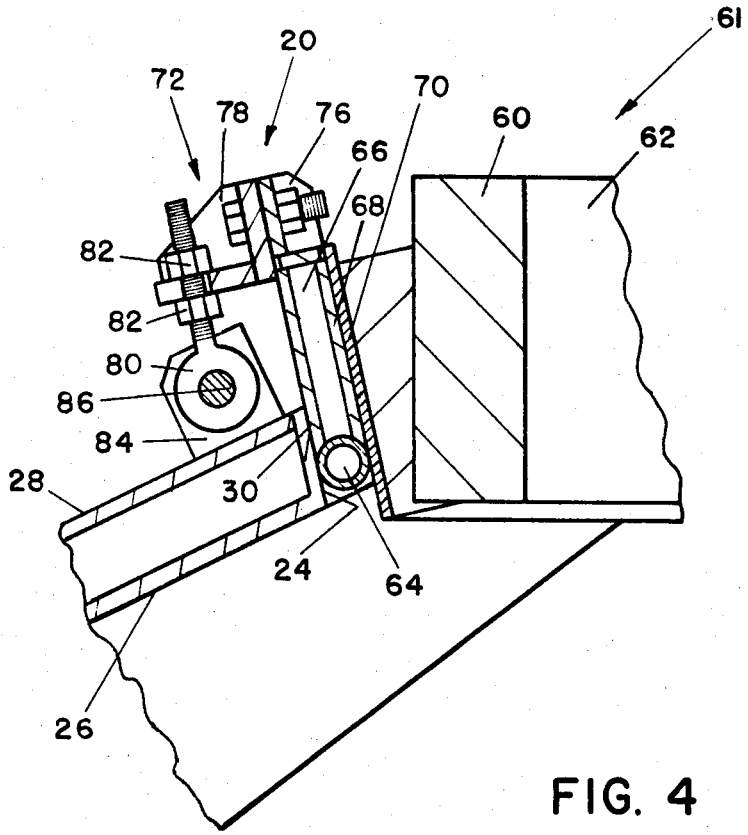
FIG. 4 is an enlarged sectional view of the upper portion of a panel unit shown in FIG. 2.
Figure 5A:
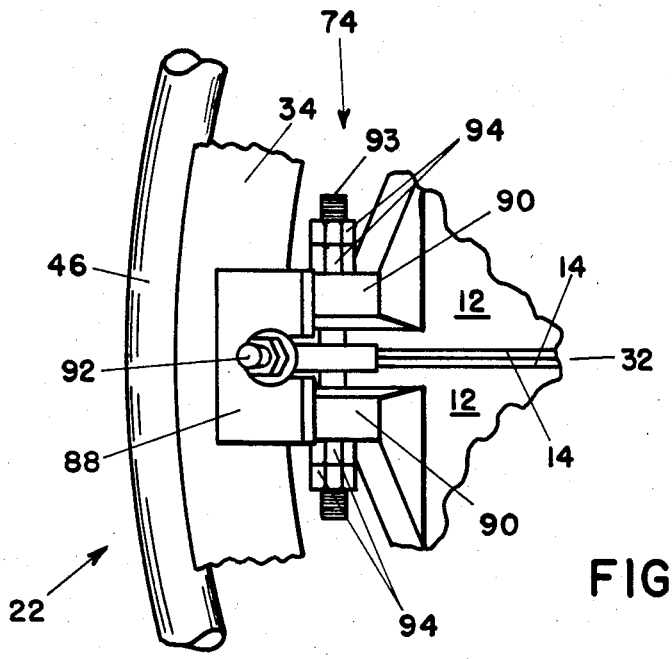
FIG. 5*a* is a plan view of FIG. 5.
Figure 5:
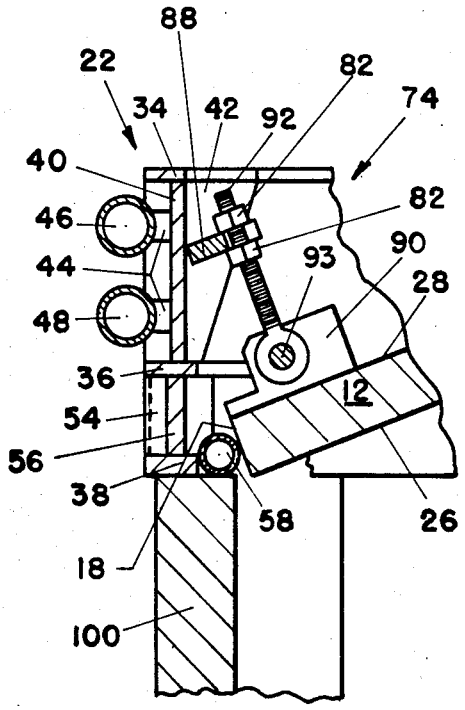
FIG. 5 is an enlarged sectional view of the lower portion of a panel unit shown in FIG. 3.

FIGS. 2 and 3 partially show the main roof section in the aforesaid frustoconical configuration. According to the teachings of the subject invention, panel unit 12 abuts and compressively fits between inner and outer support rings 20 and 22, respectively, but does not contact the neighboring panel units. FIGS. 4 and 4*a* illustrate an enlargement of the upper portion of panel unit 12 abutting against inner ring 20, and FIGS. 5 and 5*a* show an enlargement of the lower portion of panel unit 12 abutting against outer ring 22. FIG. 6 shows a non-contacting relationship of two adjacent panel units 12. This compressive fit of panel unit 12 tightly between rings 20 and 22, and the non-contacting aspect of immediately adjacent panel units is due, in part, to the particular construction of panel unit 12 which will be discussed with reference to FIGS. 1 through 6.

As mentioned above, each trapezoidal-shaped panel unit 12 has two arcuate bases 16 and 18. Arcuate base 16 abutting inner ring 20 is shorter along its chord length than that of arcuate base 18 abutting outer ring 22. The surfaces of both arcuate bases 16 and 18 are such that engagement generally occurs along its respective corresponding contacting surfaces with inner and outer rings 20, 22; i.e. the arcuate portion of outer ring 22 against which the lower section of panel unit 12 abuts has a radius corresponding to that of longer arcuate base 18, and likewise, the portion of inner ring 20 against which the upper portion of panel unit 12 abuts has a radius corresponding to that of shorter arcuate base 16.

In order to obtain the compressive fit of panel unit 12, shorter arcuate base 16 incorporates a slanted surface 24 which is shown in FIGS. 2, 3, and 4 but best shown in FIG. 4, and which when considered from the bottom surface 26 of panel unit 12 running upwardly away from outer ring 22 towards inner ring 20 forms an obtuse angle. The slanting of arcuate base 24 downwardly from the top surface 28 to the bottom surface 26 of panel unit 12 corresponds to the angular configuration and positioning of inner ring 20 in the assembled roof as shown in FIGS. 2 through 4. This angular positioning of inner ring 20 makes an acute angle when considered relative to a vertical centerline of the furnace generated from a point on the centerline below the unit. The matching of surface 24 of arcuate base 16 with that of surface 30 of inner ring 20 assures the compressive interference fit, in that this enables a wedging action to occur in the positioning of panel unit 12 between inner and outer rings 20, 22 during the assembling operation of the roof. The panel unit's weight is forced downwardly against and is taken up mostly by the outer ring 22. (More about which will be discussed shortly.)

The two longitudinal sides 14 of each panel unit 12, which as mentioned earlier, and as shown particularly in FIG. 1 run parallel to an adjacent assembled panel unit.

As can be seen in FIGS. 2, 3, and 4 arcuate bases 18 and 16 have surface areas extending between top and bottom surfaces 28, 26 respectively, which surface portions also extend along the chord length of panel unit 12. This surface portion for shorter arcuate base 16 consists of sloped or slanted surface 24 and the surface portion of longer arcuate base 18 is rectangular when considered from the top surface 28 to the bottom surface 26 as particularly shown to the left of FIGS. 2 and 3 where longer arcuate base 18 abuts member 58. The slanted surface 24 of shorter arcuate base 16 gives top surface 28 a greater surface area along its length and chord length than that of bottom surface 26.

FIG. 6 shows in exaggerated form that surface 14 of panel unit 12 is designed to be perpendicular with respect to either the top or bottom surfaces 28, 26 respectively of panel unit 12. This straight sided configuration of longitudinal perpendicular surface 14 in conjunction with the proper transverse or chord lengths for arcuate bases 16 and 18 create a gap 32 and dictates the extent of this opening 32 between each assembled panel unit 12.

This opening 32 occurs along the entire length of the longitudinal sides 14 of the two adjacent panel units 12, and takes the form of a stylized "V" whose legs do not touch. This non-contacting relationship of the sides 14 allows expansion and contraction of each panel unit 12 to occur during and between the heats of the furnace.

Since there exists a compressive fit of each panel unit 12 between inner and outer ring 20, 22, and a clearance all along the longitudinal sides 14 between each assembled panel unit 12, it is to be appreciated that the panel units 12 are totally, supported only by both rings 20 and 22, with most of the weight of each panel unit 12 being thrown or transferred to the outer ring 22, since the outer ring is lower than the inner ring 20.

In the assembling stage of the roof assembly 10, refractory ram or other suitable material is applied between groove 32 (FIGS. 1 and 6) to initially seal the panel units 12 together. In the operation of the furnace, slag adhers to the bottom 26 of each panel unit 12 on the undersurface of the roof assembly, thereby adding to and improving the overall initial sealing condition of the roof assembly.

Panel unit 12 may be cast metal as shown by the cross-hatched bottom half of panel unit 12 in FIGS. 2 and in FIG. 3, or it may be a fabricated plate metal as shown by the upper portion of panel unit 12 in FIG. 2. Even though not shown, each panel unit 12 has internal passageways for distributing coolant throughout each unit 12, which passageways may be similar to those disclosed in the aforesaid U.S. patents.

Outer support ring 22 defines the outer periphery of the entire roof assembly 10. This ring 22 is of a fabricated welded metal construction comprising three flat annular members 34, 36, and 38. Top annular member 34 is spaced away from inner member 36 by a vertical ring member 40 to which several spaced-apart gusset members 42 are attached and which support, by welded couplet members 44, coolant discharge and supply headers 46, 48 respectively. Discharge and supply headers 46, 48 are seamless steel pipes but can also be of a fabricated construction. These headers 46, 48 extend circumferentially around the roof assembly 10. Gussets 42 are evenly spaced circumferentially around the vertical ring member 40 to give the necessary support to headers 46 and 48.

Inner annular member 36 is spaced away from bottom annular plate 38 by members 50, which as shown in FIG. 1 are a two-piece "Y" member. In FIG. 1, members 50 are shown to be evenly spaced relative to each other and it is to be understood that each similar roof portion has a like number of these members 50. This even spacing arrangement of members 50 provides a dual function in that not only is the adequate support given to the upper portion of outer ring 22, but two neighboring "Y" members 50 define an opening 52. For each panel unit 12, there are several such openings 52. During the heats of the furnace, debris which tends to land on top of panel units 12 is allowed to flow off the units 12 through openings 52. Arrows in FIGS. 1 and 2 indicate this flow of debris off the roof assembly 10.

Two-piece member 50 consists of an angle iron 54 and gusset member 56, and one leg of angle iron 54 cooperates with that of the immediate neighboring member 50 to direct the flow of debris pass structural member 50 off of the roof. Gusset members 50 touch and support a conduit or seamless steel pipe 58 and maintain the shape of inner annular members 36. Gussets 42 and 56 tie the elements of outer ring 22 together and add rigidity between their respective annular members 34, 36 and 38, and therefore, to the entire outer ring 22 construction.

As shown in FIGS. 2 and 3, panel unit 12 makes point contact with outer pipe 58. This point contact is brought about by the oval configuration of pipe 58 in a transverse cross section view which provides a pivotal point around which panel 12 can freely rotate. This freedom of movement is necessary in order to obtain and, thereafter, maintain the wedging action of the panels between the rings 20 and 22. A flat surface contact with outer ring 22 may tend to restrict the movement of the panel preventing a desirable wedging action to occur. Pipe 58 is concentric to annular members 34, 36, 38, as well as to headers 46 and 48, and is used to carry coolant around the perimeter of the roof. Pipe 58 is smaller than headers 46, 48 and may be a standard 2 inch pipe or a greater pipe size depending on the size of the electric arc furnace. This point contact between panel unit 12 and pipe 58 creates a sealing condition which enhances the overall sealing condition for the roof assembly 10.

The components of outer ring 22 are welded together. At the point of contact between panel unit 12 and pipe 58, coolant in pipe 58 dissipates in this area an amount of thermal energy generated in the furnace to protect the weldment areas from excess heat and thus, preventing or at least lessening the distortion of outer ring 22, which would normally occur in view of the immense heat flux.

Inner ring 20 is also of a welded fabricated metal structure and defines the outer periphery of the refractory delta center 60 which has at least three openings. One such opening is indicated at 62 in FIGS. 2 and 4, and receives an electrode (not shown) used to create an arc in the normal operation of an electric arc furnace. Inner ring 20 comprises a lower circular seamless steel pipe 64 which in some cases can instead be of a fabricated construction, and an annular chamber 66, which is integrally welded to inner pipe 64, and which connection is an even surface on one side 30 corresponding to the smooth angled surface 24 of panel unit 12 and an even surface on the other side 68 to receive and support a lightweight fabricated ring member 70 used for supporting the refractory delta center 60, which may be a one-piece cast construction or composed of several bricks.

Inner pipe 64 carries coolant around roof top 61 to cool the area between delta center 60 and the main roof portion consisting of the severally arranged panel units 12, and more importantly, cools contacting surface 30 of inner ring 20 with surface 24 of panel units 12, and surface 68 of inner ring 20 with that of ring member 70. A connecting channel (not shown) conveys coolant from pipe 64 to chamber 66 where it is carried away by appropriate conduit means (not shown) from the center roof section 60.

Similarly to outer pipe 58, the coolant and size of inner pipe 64 dissipates in the contacting areas of the panels an amount of thermal energy generated in the furnace to protect the weldment areas of inner ring 20 from excess heat which in most instances would distort its shape.

For ease in assembling panel units 12 between inner and outer rings 20, 22, fastener 72 located at the top portion, and fasteners 74 located at the bottom portion of panel unit 12 are used. As can be seen in FIG. 1, fastener 72 is located approximately in the center of arcuate base 16, and fasteners 74 are located at opposite ends along arcuate base 18.

In referring particularly to FIGS. 4 and 4*a*, securing means 72 comprises an upright member 76 mounted to the top of inner ring 20. Bolted to member 76 is a bracket 78 through which suspension bolt 80 and double nut assembly 82 is suspended. Suspension bolt 80 is arranged concentric to openings in two spaced-apart lugs 84 (FIG. 4*a*), which openings receive a pin 86. This pin 86 extends through suspension bolt 80 and lugs 84 is secured therein by appropriate means, i.e. nuts or cotter pins (not shown).

As shown particularly in FIGS. 5 and 5*a*, securing means 74 has a bracket 88 welded to outer ring 22, and as FIG. 5*a* illustrates, has two lug members 90, each mounted to an individual adjacent panel unit 12. Here again, a suspension bolt 92 is suspended down through bracket 88 between lug members 90. Pin 93 extends through suspension bolt 92 and a corresponding opening in each lug 90 to receive nuts 94 or other appropriate fastening means on each of its extended ends. Fastening means 72 and 74 are basically used for the initial assembling of panel units 12 but not for their total support. As stated earlier, panel units 12 are arranged circularly around the roof to constitute a main roof section of the entire roof assembly 10. FIGS. 2 and 3 illustrate generally a half of this main roof section, but it is to be understood that the cross sectional view of any of the panel units 12 arranged in a 360 degree radius would be similar to that shown in FIGS. 2 and 3.

In the assembling of the roof, outer support ring 22 is generally placed in position on the work floor area remote from the furnace. Each panel unit 12 is held in a slanted position similar to that shown in FIGS. 2 and 3 by a temporary support (not shown). When all panel units 12 are arranged and held in the frustoconical configuration partially shown in FIGS. 2 and 3, inner ring 20 is inserted in the annular opening formed by all the arcuate bases 16 of the assembled panel units 12. The relative level or height of each panel unit 12 and its alignment is brought about through the rotation of nuts 82 on suspension bolts 80, 92 of fasteners 72 and 74. Each panel unit 12 is positioned such that surfaces of arcuate bases 16 and 18 compressively contact surface 30 of inner ring 20 and the external surface of outer pipe 58 of outer ring 22. After assembly of each panel unit is completed the weight of panel unit 12 is not supported by the toggle or fasteners 72, 74 but is taken up by inner and outer rings 20, 22, and as mentioned earlier is thrown outwardly to outer ring 22 through pipe 58 and transferred to bottom annular member 38. Outer ring 22, inner ring 20 and the panel units 12 can then be lifted as an integral unit. The compression factor of these three elements 20, 22, 12 depends on the dimension of the outer diameter of inner ring 20, the inner diameter of outer ring 22, the lengths of panel units 12, and the radii of arcuate bases 16 and 18. The angle or slanting or arcuate base 16 to correspond to that of surface 30 of inner ring 20 is such that a compressive fit is accomplished.

After the main roof section is assemblied, annular ring 70 with delta center 60 can be easily placed into and removed from the annular opening defined by the placement of inner ring 20 in the roof assembly.

The supply of coolant to outer ring pipe 58, inner ring pipe 64, and panel units 12 through conduit 96 is by suitable flexible conduit means connected to supply header 48, and the discharging of coolant away from pipes 58 and 64, and panel units 12 through conduit 98 is also by suitable flexible conduit means connected to discharge header 46. Some suitable conduit connections are shown in FIG. 2, one of which is indicated at 47. Conduit means (not shown) are also provided for the bringing and taking away the liquid from the roof assembly. The coolant can be one of several fluids, but in this application, the coolant is water.

The entire roof assembly 10 is self-contained, and is lifted from the assembly area and placed on the sidewall of the furnace which in FIGS. 2, 3, and 5 show that sidewall 100 supports annular ring 38. In the event a panel unit 12 is damaged or destroyed through the many heats in the furnace, removal and replacement thereof is easily done through the top of the roof assembly on the furnace without disturbing the arrangement and positioning of any of the remaining panel units 12, since they directly contact rings 20, 22, and there is no physical touching of panel units 12 relative to each other.

With respect to fasteners 72 associated with inner ring 20, detachment of bracket 78 from upright member 76 allows removal and replacement of a panel unit 12 without removal of inner ring 20.

The overall design for a roof assembly according to the teachings of the subject invention makes assembly and disassembly thereof relatively easy.

In certain applications it may not be necessary for the compartments of the roof assembly to contain means for cooling; i.e. it is not necessary for inner and outer pipes 64, 58 to be cooled.

In accordance with the provisions of the patent statutes, I have explained the principle and operation of my invention and have illustrated and described what I consider to represent the best embodiment thereof.

I claim:

1. A panel unit for use in a roof assembly of an electric arc furnace, comprising:

a trapezoidal shaped body having top and bottom surfaces, two arcuate bases wherein one is shorter than the other along the chord length, and two longitudinal sides, said shorter and longer arcuate bases having surface portions between said top and bottom surfaces, and which in the cross section of said panel unit along said chord length thereof, said top surface has a greater surface area than said bottom surface such that said surface portion of said shorter arcuate base has a slope from said top surface to said bottom surface of said panel unit, and said surface portion of said longer arcuate base is rectangular from said top surface to said bottom surface of said panel unit.

2. A panel unit according to claim 1, further comprising:

bracket means mounted on said panel unit at predetermined locations constructed and arranged to receive fastening means for positioning said panel unit into place in said roof assembly.

3. A panel unit according to claim 1, further comprising: internal passageways for distributing coolant throughout said trapezoidal-shaped body, and external conduit means communicating with said passageways for delivering to and carrying away said coolant from said panel unit.

* * * * *